United States Patent [19]

Ichelson

[11] 4,202,343

[45] May 13, 1980

[54] JOGGER'S BRASSIERE

[76] Inventor: David L. Ichelson, 155 Birch St., Redwood City, Calif. 94062

[21] Appl. No.: 905,409

[22] Filed: May 15, 1978

[51] Int. Cl.[2] ..... A41C 3/02

[52] U.S. Cl. ..... 128/438

[58] Field of Search ..... 128/438, 430, 459, 482, 128/439, 450, 452, 457, 510, 511

[56] References Cited

U.S. PATENT DOCUMENTS

| | | | |
|---|---|---|---|
| 1,522,658 | 1/1925 | Voorhees | 128/482 |
| 3,008,468 | 11/1961 | Williams | 128/510 |
| 3,982,547 | 9/1976 | Walker | 128/452 |

FOREIGN PATENT DOCUMENTS

| | | | |
|---|---|---|---|
| 759845 | 11/1933 | France | 128/438 |

*Primary Examiner*—Werner H. Schroeder
*Assistant Examiner*—Doris L. Troutman
*Attorney, Agent, or Firm*—Julian Caplan

[57] ABSTRACT

A brassiere comprising a body encircling band having a pair of breast cups and shoulder straps, and a pair of midriff straps secured at the bottom of the breast cups and attachable at their opposite ends to a waist encircling garment such as a belt or shorts, the midriff straps being used to urge the breasts downwardly to prevent undue movement thereof while jogging. In an alternate brassiere, the shoulder straps cross at the wearer's back, pass through loops at the sides and extend upwardly to where they are secured to the lower porton of the breast cups, the loops being secured to the waist encircling garment.

3 Claims, 7 Drawing Figures

JOGGER'S BRASSIERE

BACKGROUND OF THE INVENTION

This invention relates to brassieres, and more particularly to brassieres for firmly holding the breasts during strenuous physical activities.

Women who engage in athletic activities such as running, jumping, etc., often require firm breast support to prevent undue movement of their breasts. Obviously, larger-breasted women will require even greater support, both to prevent unbalancing due to lateral or up and down movement of their breasts, and, most importantly, to reduce any possibility of injury to the breasts due to such uncontrolled movement.

A variety of brassiere constructions are presently available, with varying purposes in mind. U.S. Pat. No. 2,364,899, for example, discloses a construction for providing comfortable breast support while at the same time permiting free and uninhibited movement of the body. U.S. Pat. No. 3,982,547 discloses a brassiere having elastic portions with clips for connection with the waistband of a pair of slacks, for supporting the slacks. U.S. Pat. No. 2,050,064 discloses a brassiere having pocket portions which can be opened for nursing purposes. See also U.S. Pat. Nos. 580,419; 2,333,268; 2,389,450; and 3,411,508.

None of the conventional brassieres, including those noted above, has been designed for the specific purpose of providing breast support for women engaged in jogging, running, jumping, etc. Significantly, no such brassiere has been developed for large breasted women, to hold the breasts firmly downward so as to reduce undue movement and possible injury thereto during such strenuous activities. Preventing upward movement of the breasts limits downward bounce, thereby minimizing discomfort.

SUMMARY OF THE INVENTION

In accordance with this invention there is provided a brassiere for firmly holding the breasts during running, jumping or similar activities comprising a body encircling band having breast cup portions, a pair of shoulder straps secured to the breast cup portions and running over the wearer's shoulders where they are anchored at the wearer's back, and a pair of midriff straps secured to the breast cup portions and extending down and attachable to a waist encircling garment, such as a belt, shorts, or the like, the midriff straps being used to exert pressure on the breast cup portions to urge the breasts downwardly. Alternately, the shoulder straps can cross at the wearer's back, after which they extend through loops at the wearer's sides and pass upwardly to where they are secured at their upper ends to the lower portion of the breast cups, the loops in turn being attached to the waist encircling garment so as to urge the breasts downwardly, as in the above construction.

It is a primary object of this invention to provide a brassiere for large breasted women joggers.

It is another object of this invention to provide a brassiere for firmly holding the wearer's breasts during strenuous athletic activities, such as running, jumping, etc. Preventing upward movement limits the downward bounce of the breasts, thereby minimizing discomfort.

It is a further object of this invention to provide a jogger's brassiere which can be easily put on and taken off, and which can be comfortably worn while jogging.

These and other objects of the invention will become apparent to those skilled in the art from a reading of the description of the preferred embodiments, as well as from examining the following described drawings.

DESCRIPTION OF THE PREFERRED EMBODIMENTS

Figure 1:
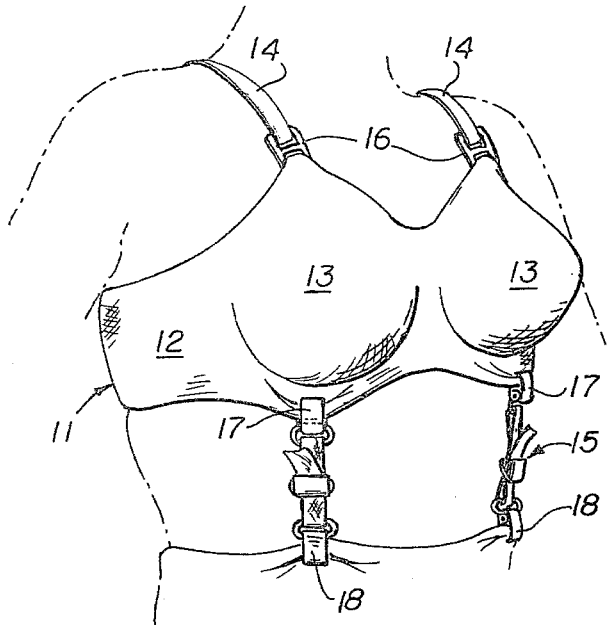
FIG. 1 is a perspective view showing one form of brassiere of this invention on the wearer.

Referring to FIG. 1, brassiere 11 is formed of a body encircling band 12 having breast cups 13, shoulder straps 14, and midriff straps 15. Each breast cup 13 encloses the entire breast. Shoulder straps 14 are secured by fasteners 16 to the upper portion of the breast cups and pass over the wearer's shoulders to where they are secured to the rear portion of the body encircling band 12, as in conventional brassieres.

Figure 2:
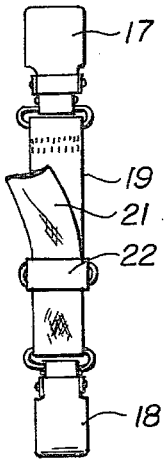
FIG. 2 is an enlarged view of one of the midriff straps of the brassiere of this invention.

Midriff straps 15, as shown in the enlarged view of FIG. 2, have upper and lower clips 17, 18, the upper clips being attached to the fabric portion of the body encircling band 12 directly beneath each of the breast cups 13. The lower clips 18 are attached to the wearer's waist encircling garment, which can be shorts, slacks, or the like. Preferably, the midriff straps 15 are formed of an elastic band 19 having a free end 21 which passes through snubber fastener 22 to allow tightening or loosening of the straps so as to exert both adequate and comfortable downward pressure on each breast cup.

The body encircling band 12 and breast cups 13, as well as shoulder straps 14, may be formed of fabrics used in conventional brassieres. For example, body encircling band 12 may have wire reinforcement sewn into the fabric, such that the upper clips 17 of the midriff straps 15, when attached to the brassiere portion under the breast cups, will be able to exert firm downward pressure on the breast cups.

In the embodiment shown in FIG. 1, the brassiere unhooks at the back. Accordingly, the brassiere can be put on and taken off as easily as a conventional brassiere, the only additional step required being that of clipping on the midriff straps 15, as shown.

In FIG. 1, the midriff straps are shown attached to a waist encircling garment in the form of slacks or shorts. However, a waist encircling band, as will be described in FIG. 7, can also be used to anchor such straps.

Figure 3:
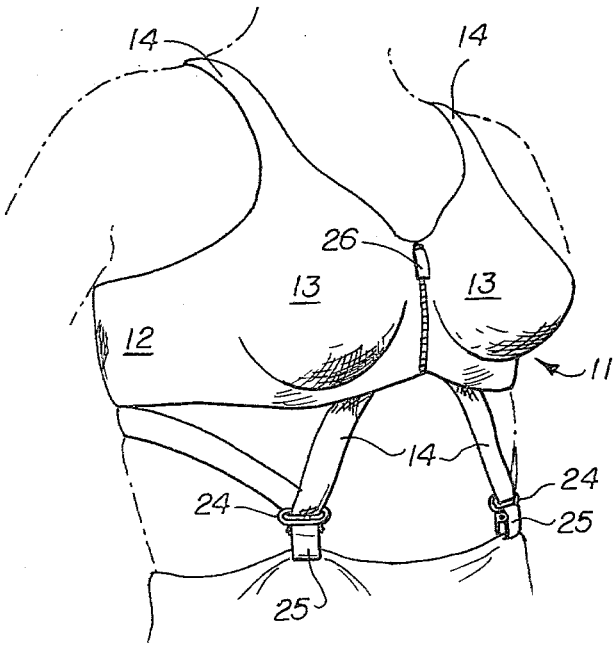
FIG. 3 is a perspective view similar to that of FIG. 1, but showing an alternative embodiment of the brassiere of this invention.
Figure 4:
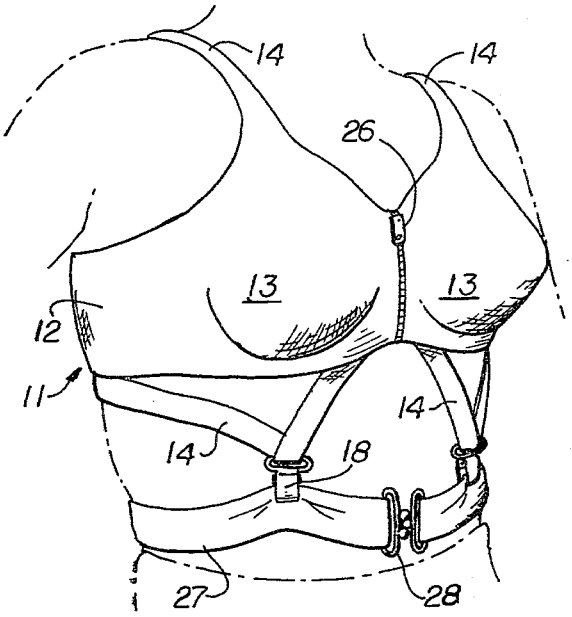
FIG. 4 is a perspective view similar to that of FIG. 3, but showing use of a waist encircling band.
Figure 5:
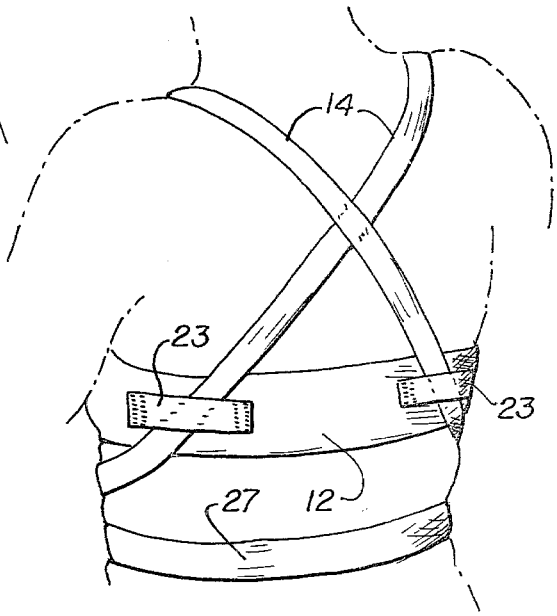
FIG. 5 is a perspective view showing the rear portion of the brassiere of FIG. 4.

Referring to FIGS. 3–5, an alternate embodiment of the invention is shown. Shoulder straps 14 cross behind the back, as shown in FIG. 5, pass through fabric loops 23 (in which they are slideably disposed) and extend around to the sides of the wearer, where they pass through loops 24 and then proceed upwardly to where they are secured under breast cups 13, as shown in FIG. 3. Clips 25 are used to attach the loops 24 to the waist encircling garment so as to obtain downward pressure on the breast cups 13, as in FIG. 1. The shoulder straps 14 are continuous with the breast cups 13, and the brassiere itself unhooks between the breast cups 13 by means of zipper 26 or snaps, ties or the like. Again, the brassiere can be easily and quickly put on and taken off, the wearer having only to manipulate clips 25 and zipper 26. Preferably, the shoulder straps 14 are formed of an elastic material, and the length is adjusted so as to exert both adequate and comfortable downward pressure on breast cups 13.

As shown in FIGS. 4, 5, a waist encircling band 27 having a front fastener 28 is used in place of a waist encircling garment as used in the embodiment shown in FIG. 1. Clips 25 are clipped directly to the waist encircling band 27, instead of to the wearer's shorts or slacks.

Figure 6:
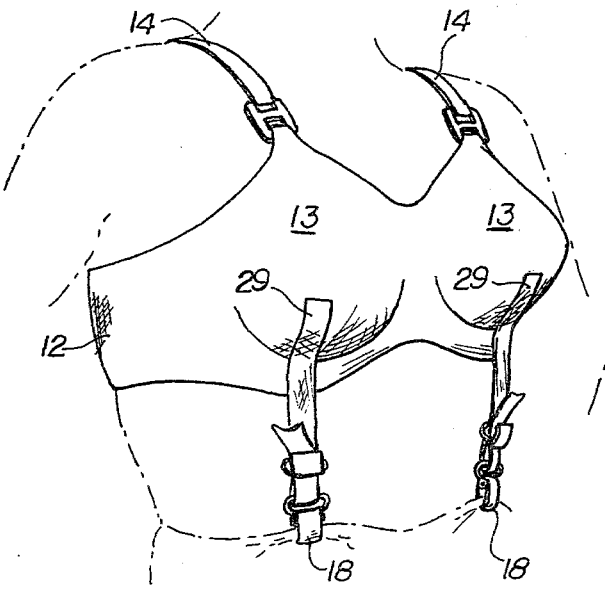
FIG. 6 is a perspective view similar to that of FIG. 1, showing an alternative embodiment of the brassiere of this invention.

In FIG. 6 an embodiment similar to that of FIG. 1 is shown, with the upper clips 17 having been removed and the upper portion 29 of the midriff straps being sewn directly to the undersurface of breast cups 13. With this construction the midriff straps 15 become a permanent part of the brassiere, such that the wearer need only attach bottom clips 18 to the waist encircling garment. Accordingly, the brassiere of this embodiment also provides an extremely simple and easily used means for reducing breast movement during strenuous activities.

Figure 7:
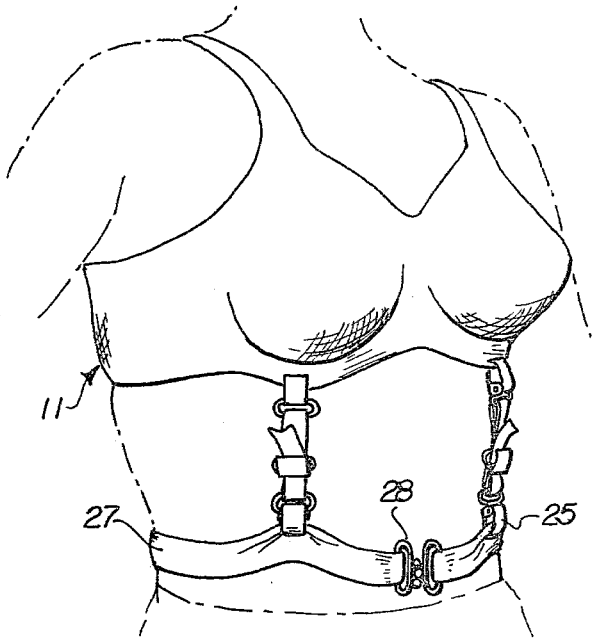
FIG. 7 is a perspective view similar to that of FIG. 1 showing use of a waist encircling band.

In FIG. 7 waist encircling band 27 having a front fastener 28 is used in place of a waist encircling garment. Clips 25 clip directly to the waist encircling band 27, as in the embodiment of FIGS. 4, 5.

I claim:

1. A brassiere for firmly holding the breasts during running, jumping or similar activities comprising:

a body encircling band having breast cup portions having undersurfaces under the breasts, elastic shoulder straps secured to the breast cup portions, running over the wearer's shoulder, and anchored at the wearer's back, and elastic midriff straps secured by sewing to the undersurfaces of said breast cup portions and extending from said band into said cup portions and extending down and attachable to a waist encircling garment, the midriff straps being used to exert pressure on the breast cup portions to urge the breasts downwardly, said straps having clips the waist encircling garment, the bands having snubbers and adjustment clips to allow tightening and loosening of the downward pressure on the breast cup portions.

2. The brassiere of claim 1 additionally comprising an elastic waist band separate from said body which serves as a waist encircling garment to which the midriff straps are attached.

3. The brassiere of claim 1 additionally comprising loop portions disposed on the rear portion of the body encircling band into which the shoulder straps are slideably disposed after crossing at the wearer's back.

* * * * *